US008207850B2

(12) United States Patent
Weller et al.

(10) Patent No.: US 8,207,850 B2
(45) Date of Patent: Jun. 26, 2012

(54) INTELLIGENT JUNGLE CANOPY SURVEILLANCE APPARATUS AND METHOD

(76) Inventors: Christopher William Weller, Gainesville, GA (US); James Henry Boschma, Huntsville, AL (US)

( * ) Notice: Subject to any disclaimer, the term of this patent is extended or adjusted under 35 U.S.C. 154(b) by 513 days.

(21) Appl. No.: 12/421,255

(22) Filed: Apr. 9, 2009

(65) Prior Publication Data

US 2010/0066537 A1 Mar. 18, 2010

Related U.S. Application Data

(60) Provisional application No. 61/125,773, filed on Apr. 29, 2008.

(51) Int. Cl.
*G08B 13/00* (2006.01)

(52) U.S. Cl. ..... 340/565; 340/539.1; 340/539.26; 340/573.3

(58) Field of Classification Search ..... 340/565, 340/566, 539.1, 539.13, 539.26, 540, 541, 340/573.1, 573.3; 342/28, 189, 192; 356/28.5, 356/5.09, 28
See application file for complete search history.

(56) References Cited

U.S. PATENT DOCUMENTS 3,569,923 A * 3/1971 Naubereit et al. ..... 367/2
3,882,495 A * 5/1975 Bolger ..... 342/189
5,867,257 A * 2/1999 Rice et al. ..... 356/28.5

* cited by examiner

*Primary Examiner* — Hung T. Nguyen
(74) *Attorney, Agent, or Firm* — Mark Clodfelter

(57) ABSTRACT

Jungle canopy surveillance apparatus and method for surveillance of human presence in a jungle canopy environment includes a plurality of sensor-relay units configured to be disposed on or near the jungle floor, and configured to detect human presence and wirelessly transmit a corresponding detection signal. At least one of the sensor-relay units is configured to receive a detection signal from another sensor-relay unit and to relay the thus-received detection signal. An artificial intelligence center is configured to be disposed on or near the top of the jungle canopy, and is configured to (i) receive at least one of the detection signal and the relayed detection signal, (ii) analyze the received at least one of the detection signal and the relayed detection signal using artificial intelligence software, and (iii) transmit a corresponding report signal to a receiving platform.

26 Claims, 5 Drawing Sheets

INTELLIGENT JUNGLE CANOPY SURVEILLANCE APPARATUS AND METHOD

This application claims priority benefit of U.S. Provisional Patent Application No. 61/125,773, filed Apr. 29, 2008 and titled INTELLIGENT CANOPY BUOY.

FIELD OF THE INVENTION

The present invention relates to apparatus and method for a surveillance system for a jungle canopy environment, and more particularly to such a system capable of use with satellite surveillance.

BACKGROUND OF THE INVENTION

Tropical rain forests form a band near the equator that covers 15% to 20% of the landmass of the Earth. The rain forests are the Earth's most complex and diversified forests and are believed to be a critical element of the planet's ecosystem. Much of the rain forest comprises multiple-layer jungle characterized by a canopy of scattered emergent trees that tower above the rest of the jungle. The tops of some species exceed 65 meters (210 feet) in height. Below the canopy, one or two additional layers of trees exist, usually at about 15 meters and 30 meters in heights. The canopy stretches for vast distances, seemingly unbroken when observed from above. However, despite overlapping tree branches, canopy trees rarely interlock or even touch. Instead they are separated from one another by a few feet.

In recent years, large numbers of people have established homesteads in or on the periphery of the rain forest. These homesteads are often primitive in nature due to their remoteness and the substantial costs and difficulty in establishing communications, building roads, and emplacing power lines and conventional telephone services. The surge in population in rain forest areas is a major factor in the rapid destruction of the forests. Hardwoods are cut from vast areas by uncontrolled and illegal logging, and huge tracts of forest are burned by narcotic-terrorists and drug traffickers to make room for the planting coca and other illicit crops. Additionally, the shelter from observation provided by the canopy attracts insurgents, terrorists, guerillas, and other agents of instability who take shelter in heavily forested regions where they can act beyond the reach of law enforcement and government intervention.

The problems faced by those governments entrusted with regulating human actions in the rain forest are surely demanding, but particularly exacerbated by an inability to observe the remote jungle and communicate those observations to authorities. In many nations, resources have poured into manpower-intensive jungle monitoring efforts and jungle-targeted counter-insurgency programs, but vast stretches of jungle remain unmonitored, off limits to national security forces, and local populations continue to be terrorized by insurgents, often funded through the drug trade. Therefore, there is a need for an efficient, cost-effective surveillance system particularly useful in heavily-jungled areas.

SUMMARY OF THE INVENTION

One aspect of the present invention is to allow under-canopy surveillance of remote jungle areas. As noted above, this has proved nearly impossible so far, despite considerable worldwide expense in money and manpower. One historical example was the inability of the U.S. Army, U.S. Navy, and U.S. Air Force to effectively detect and interdict the North Vietnamese moving personnel and armor into South Vietnam below the jungle canopy in Viet Nam, Laos, and Cambodia.

According to another aspect of the present invention, a system for surveillance of human presence in a jungle canopy environment includes a plurality of sensor-relay units configured to be disposed on or near the jungle floor, and configured to detect human presence and wirelessly transmit a corresponding detection signal. At least one of the sensor-relay units is configured to receive a detection signal from another sensor-relay unit and to relay the thus-received detection signal. An artificial intelligence center is configured to be disposed on or near the top of the jungle canopy, and is configured to (i) receive at least one of the detection signal and the relayed detection signal, (ii) analyze the received at least one of the detection signal and the relayed detection signal using artificial intelligence software, and (iii) transmit a corresponding report signal to a receiving platform.

According to a further aspect of the present invention, a method of operating a jungle surveillance system having a plurality of sensor-relay units disposed on or near the jungle floor, and at least one artificial intelligence center disposed on or near the top of the jungle canopy, includes the steps of: (i) wirelessly transmitting surveillance signals from at least one of the plurality of the sensor-relay units to the at least one artificial intelligence center; (ii) wirelessly transmitting surveillance signals from at least one of the plurality of the sensor-relay units to another one of the plurality of the sensor-relay units, which relays the thus-received surveillance signals to the at least one artificial intelligence center; (iii) receiving at the at least one artificial intelligence center (a) the transmitted surveillance signals and (b) the relayed surveillance signals; (iv) analyzing at the at least one artificial intelligence center the received (a) transmitted surveillance signals and (b) relayed surveillance signals, using artificial intelligence software; (v) producing at the at least one artificial intelligence center a natural language surveillance report corresponding to the analyzed received (a) transmitted surveillance signals and (b) relayed surveillance signals; and (vi) transmitting the surveillance report from the at least one artificial intelligence center to an aerial or space-based platform.

According to yet another aspect of the present invention, buoy support apparatus configured to support wireless electrical signaling structure on top of or near the top of a jungle canopy includes a central support structure adapted to support the wireless electrical signaling structure. A plurality of substantially radially-extending leg elements are disposed in the shape of spider legs, each leg element being substantially 3-10 meters in length. The plurality of substantially radially-extending leg elements are configured so that the central support structure resides on top of or substantially near the top of the jungle canopy.

According to yet a further aspect of the present invention, jungle surveillance artificial intelligence center apparatus includes an upper antenna configured to communicate with an aerial or space-based platform, and a lower antenna configured to communicate with one or more sensor-relay units disposed on or near the jungle floor. Transmitter and receiver structure is configured to communicate with the aerial or space-based platform and the one or more sensor-relay units. A power system including a solar power device is provided. A buoy support structure is configured to retain the jungle surveillance artificial intelligence center apparatus at or near the top of the jungle canopy. Processing structure, coupled to said transmitter and receiver structure, is configured to (i) analyze signals from the one or more sensor-relay units, (ii) form a surveillance report corresponding to the analyzed signals from the one or more sensor-relay units, and (iii) output a report signal corresponding to the formed surveillance report.

According to another aspect of the present invention, jungle surveillance sensor-relay apparatus includes a plurality of sensors, each configured to detect a human presence in the jungle. A receiver is configured to wirelessly receive (i) signals from an artificial intelligence center and (ii) signals from at least on other jungle surveillance sensor-relay apparatus. A transmitter is configured to wirelessly transmit to the artificial intelligence center detection signals corresponding to the received (i) signals from the artificial intelligence center and (ii) signals from at least one other jungle surveillance sensor-relay apparatus.

BRIEF DESCRIPTION OF THE DRAWINGS

The advantageous features according to the present invention will be more readily understood from the following description of the Detail Description of the Presently Preferred Embodiments taken in conjunction with the Drawings which show.

DETAILED DESCRIPTION OF THE PRESENTLY PREFERRED EMBODIMENTS

As a system overview, the presently preferred embodiments of the present invention comprise a system, method, and apparatus for surveillance under a jungle canopy, wherein a network of ground-based sensors and relays transmit signals to each other and thence to one or more treetop-based artificial intelligence centers, (AI centers). The received signals are then analyzed in the AI center(s) for human presence, motion and residence time, and the resulting information is compiled into a user-friendly report written in natural language and containing imagery (when available). The report is then transmitted to an aerial or space-based platform, such as an overhead satellite, aircraft, or airship (such as a blimp).

A sensor as herein defined can have one or more sensor features known in the art, which include: infrared cameras, optical cameras, acoustic microphones, chemical detectors, smoke detectors, seismic and vibration sensors, RF sensors, radioactivity sensors, and equivalents thereof. Sensors containing one or more of the above features are readily available through commercial or military means. They are preferably battery powered and can be positioned on the ground or at lower heights in understory trees and bushes (as appropriate), forming a sensor network extending over an expanse of several square miles, or more, on the jungle floor.

A single relay herein defined is positioned on the ground below the jungle canopy or at lower heights in trees and bushes (as appropriate). The relay is preferably used to receive and transmit surveillance information from other sensors, relays, and AI center(s). The relay is available commercially, and a relay network can be positioned over an expanse of several square miles (or more) on the jungle floor.

In a particularly preferred embodiment, one sensor (as described above) is beneficially combined with one relay (as described above) to form a single combined "sensor-relay" unit. This novel sensor-relay unit is comprised of components that are each available through commercial and/or military channels, but the combination is unique. Each sensor-relay unit is preferably battery-powered and camouflaged. A network of these sensor-relay units can be positioned over an expanse of several square miles (or more) on the jungle floor by delivery means such as airplane, helicopter, ground forces, or the like. Advantages of using the preferred single sensor-relay network instead of the more conventional separate sensor network and relay network described above include the reduction of two otherwise separate networks to one, reduction of parts count, and simplicity of system operation.

Figure 1:
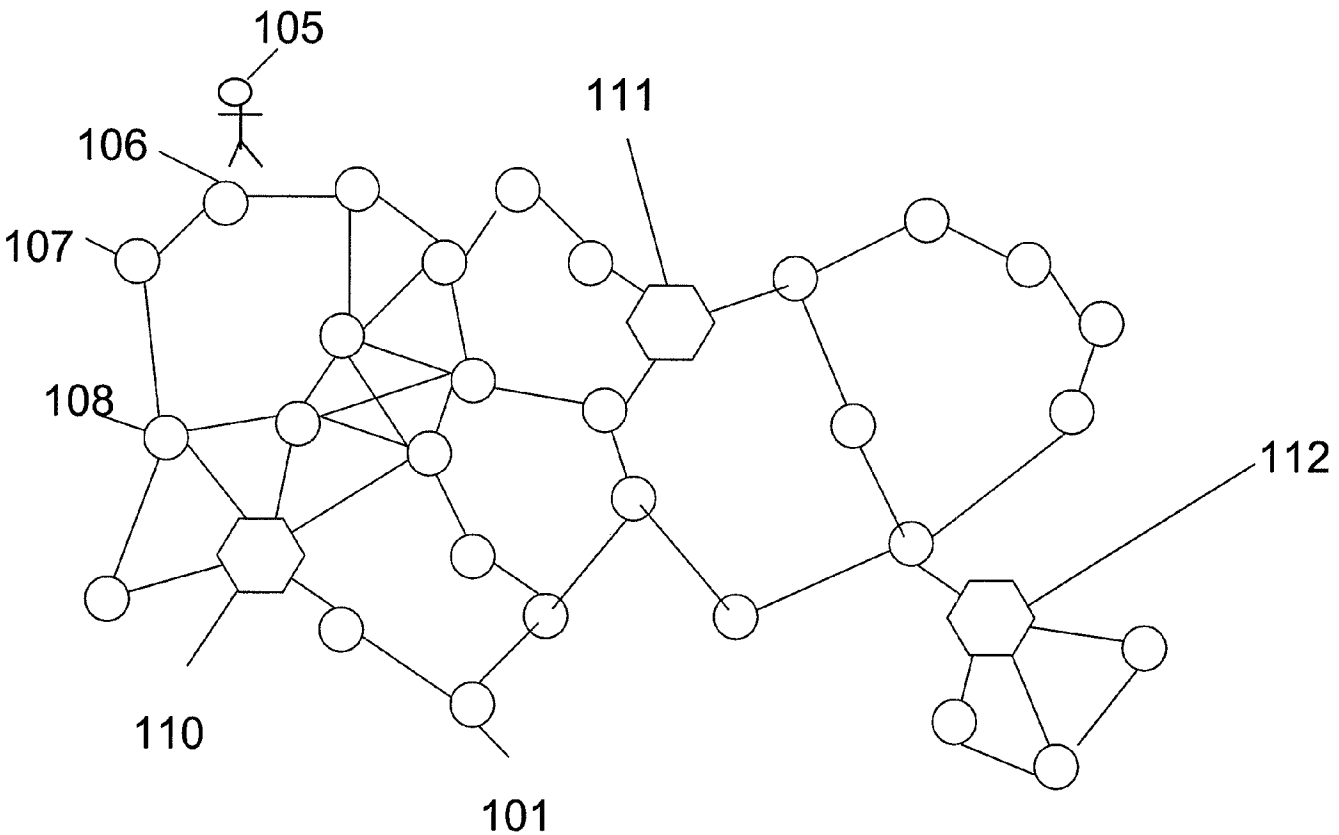
FIG. 1 is a schematic diagram of a surveillance system network according to an embodiment of the present invention.

Referring to FIG. 1, a network of sensor-relay units and AI centers is shown schematically in the surveillance system network 100. Each sensor-relay unit (to be described in greater detail below) corresponds to a circular shaped node 101, 105, 106, 107, etc. At least one sensor-relay unit 101 is typically located at the edge of the network 100. The totality of sensor-relay units in the surveillance system network 100 comprises a sensor-relay network. Generally, some sensor-relay units will be relatively near to each other and some will be relatively far from each other, depending upon the terrain and the coverage of each sensor-relay unit. Preferably, the distance between two adjacent sensor-relay units may be 2000 meters, more preferably 1000 meters, even more preferably 500 meters, still more preferably 250 meters, even more preferably 100 meters, or even more preferably 50, or 25 meters. Wireless communication between the sensor-relay units is predominantly short range, for example: 2000 to 25 meters, due to limited battery power for transmission, and this preferentially favors communication between the more closely spaced units. For clarity, FIG. 1 shows communication lines connecting only the more closely spaced sensor-relay units. Each sensor-relay unit includes one or more processors and/or computers with appropriate ROM, RAM, etc. configured to perform appropriate signal conditioning and signal processing to gather detection signals from the on-board sensor(s) and from other sensor-relay units, and to transmit these signals to one or more AI centers and/or other sensor-relay unit(s).

Also shown in FIG. 1 are several AI centers 110, 111 and 112 sprinkled among the sensor-relay nodes. These are shown in the figure as hexagonal shapes to distinguish them from the circular nodes depicting the sensor-relay units. Altogether, the network of sensor-relay units and AI center(s) comprise the surveillance network 100. There are approximately 10-100× more sensor-relay units than AI centers, primarily because of the relative high cost of the AI centers, although one, two, three, four, five, or more sensor-relay units to each AI center may be used, depending on the target, the terrain, etc. Each AI center is preferably equipped with a GPS transmitter and/or receiver, and is positioned atop the jungle canopy. Each AI center is preferably powered by solar panels and a backup battery, and each AI center receives signals transmitted from the sensor-relay nodes, processes the information using AI, and transmits AI information to a satellite.

Consider the operation of the surveillance system network 100 as shown in FIG. 1. Sensors on the jungle floor are preferably designed to detect the presence of a human 105, by use of one or more features known to the sensor art, as described above, such as motion-sensors, vibration sensors, IR sensors, visual cameras, audio sensors, so-called "smell" sensors, etc. An unwanted human presence 105 appears on the scene. The presence can be a person, a tank, a jeep, moped, truck, bicycle, helicopter, etc. A nearby sensor-relay unit 106 detects this human presence 105. A signal describing this human presence 105 is generated by the sensor-relay unit 106, and transmitted by wireless to the sensor-relay network. Since the wireless signal is generally weak but adequate for the shorter transmission distances, the closer node 107 in the network will receive the stronger signal. Accordingly, the sensor-relay unit 106 transmits the signal to the nearby sensor-relay 107, which, in turn, transmits the signal to the nearby sensor-relay 108. At the end of the sensor-to-sensor signal transmission chain, the sensor-relay 108 transmits the signal to the nearby AI center 110. Therefore, the signal makes its way by sequential hops from sensor-relay unit 106 to AI center 110. The AI center 110 analyzes this signal, compares it with other temporal and spatial signals, and produces a user-friendly report which is composed in natural language and may contain pictorial information as well. This report is transmitted overhead to a satellite on-demand, upon signal reception, or according to a predetermined schedule or event based hierarchical criteria.

In the general case, there will be a multiplicity of paths through several nodes from the human presence 105 to the AI center 110, and each path will transmit the same signal to the AI center 110. This is a beneficial feature since it provides redundancy in case of outage problems in the field. The software in the AI center 110 is designed to process each piece of surveillance information only once, so there will be no duplication of surveillance information and no ringing of data.

In the surveillance system network 100, there are shown several AI centers 110, 111, and 112 dispersed among the sensor-relay nodes. Since each of the AI centers is equipped with a GPS and each communicates regularly with a satellite, it is possible and desirable at the outset to determine the ground coordinates of all sensor-relay nodes, using triangulation between wireless signals transmitted and received between multiple AI centers, say 110, 111, and 112. Coordinates of all the sensor-relay units in FIG. 100 are then known. In the present example, the AI center 110 knows the coordinates of sensor-relay 106 which is in closest proximity to the human element 105. Triangulation as described above is desirable if the sensor-relays are deployed from an airplane, but may not be necessary if the sensor-relays are either dropped on the ground by a low-flying helicopter or positioned on the ground by specially trained ground forces.

Over time, the human presence 105 may move, dwell, increase, change, etc., and this surveillance information can be detected and compiled. This surveillance information together with other temporal and spatial surveillance information obtained from the sensor-relay units is then analyzed and interpreted by the AI center and subsequently transmitted to an overhead satellite. In addition, there is supplemental surveillance information obtainable by special sensors located above and below each AI center that will be folded into the surveillance information obtainable through the sensor-relay network as described above. This supplemental surveillance information and related equipment will be described with respect to FIGS. 3 and 4.

Figure 2:
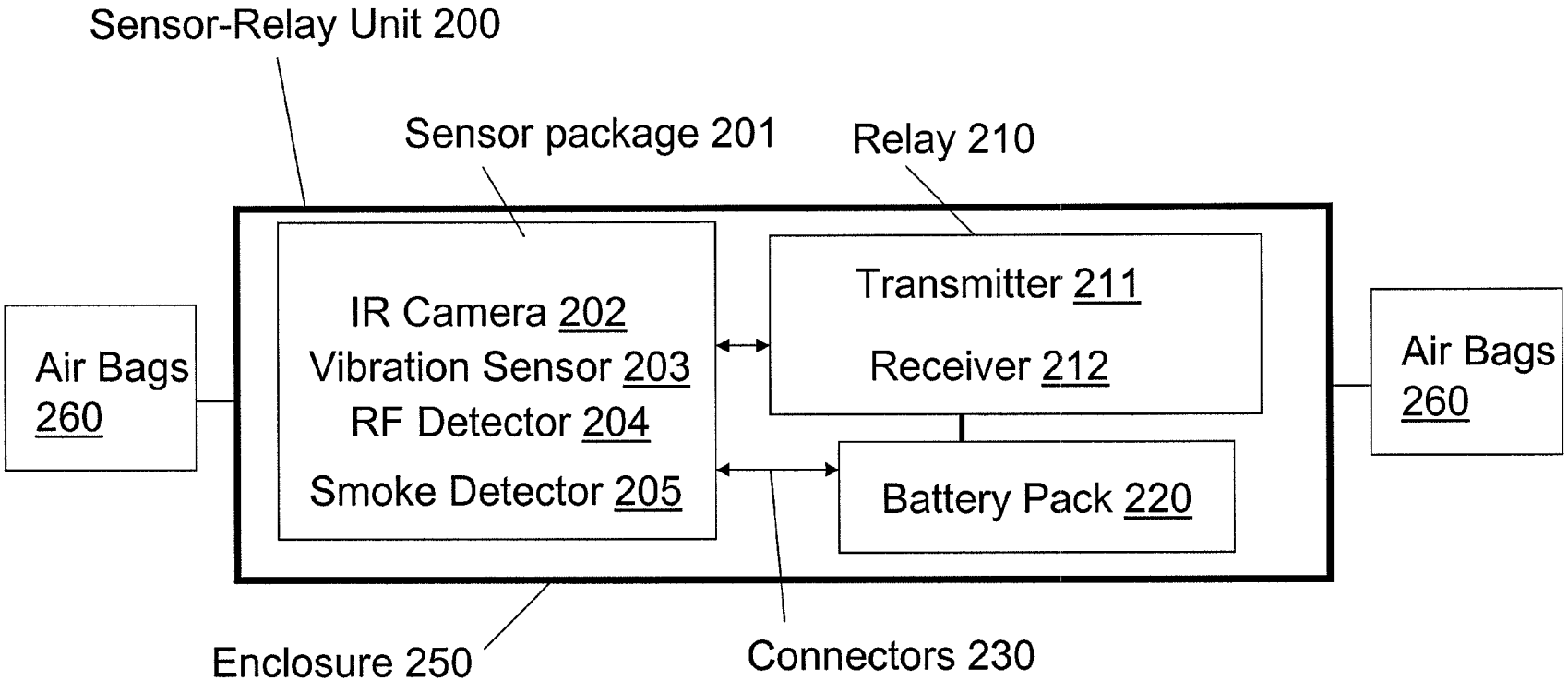
FIG. 2 is a schematic diagram of a sensor relay unit according to an embodiment of the present invention.

A preferred sensor-relay unit 200 is shown in FIG. 2. Several typical sensors are depicted in a sensor package 201, including: IR camera 202, vibration sensor 203, RF detector 204, and smoke detector 205. This package is meant to be descriptive and not limiting. For example, other sensors known to the art can be added, and some sensors already described, such as IR camera 202, can be deleted, leaving at least one sensor in the sensor package 201. A relay 210 is also included in the sensor-relay units. The relay package 210 contains a wireless transmitter 211 and a wireless receiver 212 for communication of surveillance information on the ground.

A battery pack 220 preferably provides power for the sensor-relay unit. It is expected that the sensors in the sensor package 201 will be powered up most of the time, since their total power requirement is relatively low. By contrast, the relay package 210 will be powered down into hibernation mode most of the time and only be activated when there is a new human presence or change in the presence is detected. This is because the transmission of wireless signals requires extensive battery power. The sensor package 201 is connected to the relay package 210 and the battery pack 220 by means of connectors 230.

The sensor-relay unit 200 is surrounded by an enclosure 250, which is fabricated from plastic or metal, preferably water/moisture-proof/resistant, and sufficiently tough to withstand drop-deployment from any type of aircraft. The exterior surface of the enclosure 250 is preferably camouflaged. The sensor-relay unit 200 has approximate dimensions of 2-30 cm×2-30 cm×2-10 cm, and an approximate weight of 0.1 to 10 kg.

In case the sensor-relay unit 200 is deployed by dropping from a moving aircraft or helicopter, then one or more inflatable and camouflaged bio-degradable air bags 360 can be appended which will decrease the impact speed of the sensor-relay unit 200 as it hits the jungle floor. After a short time in the humid jungle environment, the biodegradable air bags will deflate and degrade. However, if the sensor relay units 200 are positioned on the jungle floor by specially trained personnel, then the air bags 360 are not necessary.

Figure 3:
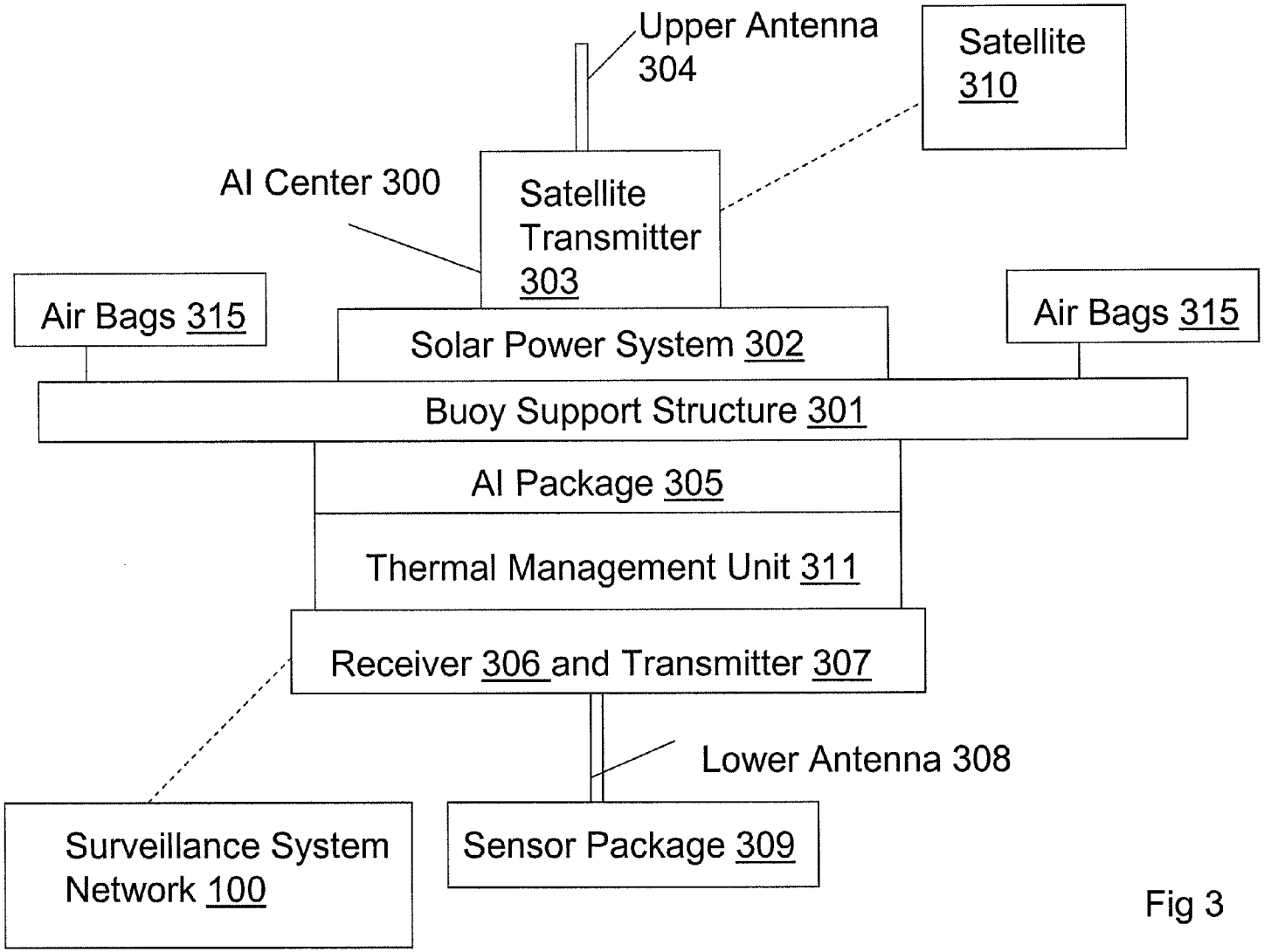
FIG. 3 is a schematic diagram of an artificial intelligence center according to an embodiment of the present invention.

A preferred AI center 300 is shown in FIG. 3. The AI center 300 is designed to be positioned atop or near the top of the jungle canopy so as to communicate with an overhead satellite 310, as well as the ground (or near ground)-based network of sensor-relays shown in FIG. 1. The AI center is preferably mechanically supported atop the forest canopy by a buoy support structure 301, which functions to attach the AI center atop (or near-atop) the forest canopy. The usual meaning of the word "buoy" implies an object which is floating atop the water. For the purposes of this document, the word "buoy" is herein generalized to include an object which is "floating" atop the forest canopy. It "floats" in the sense that it will move vertically as the trees grow, and it may move horizontally as wind moves the upper trees and their branches. More details of the buoy support structure and its camouflage will be provided below in the description of FIGS. 4 and 5. The AI center 300 may also move like a UAV (unmanned aerial vehicle) from tree-to-tree in accordance with tree growth and wind (much like a ball will float on the waves of the ocean).

As shown in FIG. 3, a solar power system 302 in the AI center 300 comprises photovoltaic solar panels and a battery backup. This is designed to last about two weeks without sunlight. In the unusual case of stormy weather lasting more than two weeks, the battery in the solar power system 302 would run out; but then the jungle floor would likely be flooded and impassable for humans or vehicles in any event.

A satellite transmitter 303 in the AI center 300 is designed to transmit surveillance information upwards to a satellite 310 passing overhead. The satellite transmitter has a main antenna which is preferably circular and lies in a horizontal plane. Equipment that may be used in the satellite transmitter can include, for example, a full duplex Tx/Rx mixed signal UHF, or other transceiver, and a 128 k Iridium Marine Satellite uplink. More details regarding the main antenna will be described below with respect to FIG. 5. Atop the Satellite Transmitter 303 is an upper supplemental vertical antenna

304 which is preferably made of a very thin rigid camouflaged wire and is preferably 1-6 meters high, more preferably 3 meters high. This can be used for communicating with nearby friendly aircraft.

An AI package 305 in the AI center 300 is designed to intelligently process the ground-based surveillance information it receives from the sensor-relay system 102. This information comprises time-varying signals describing movement, sight, vibration, sound, smell, etc. generated at one or more sites on or near the jungle floor. As noted above, each sensor-relay unit has known coordinates on the jungle floor which are determined by triangulation of preferably three AI centers. These coordinates allow each AI center to determine where and when each signal is coming from. In general, there will be a multiplicity of signals arriving at the AI package from a multiplicity of sensor-relay units in different locations. All these signals arriving at the AI package 305 will be interpreted and analyzed by the AI package 305 to determine if the signals are caused by a human presence, such as personnel, tanks, jeeps, etc. If this is the case, then the AI package 305 will collate this surveillance information and present it a user-friendly report using natural language with appended image signal photos, if available. This report is then transmitted upwards to the overhead satellite or a friendly aircraft, from where it can be subsequently reviewed by responsible parties. When AI center receives surveillance signals from one or more sensor-relay units, the AI center preferably transmits a control message to the sensor-relay units to stop transmitting subsequent duplicate signals.

Software and hardware that is used in the AI package 305 preferably includes, for example, (i) hardware comprising one or more processors and/or general purpose computers, ROM, RAM, I/O circuitry, etc., and (ii) software such as artificial neural net and hyper-threading technology with hibernation mode, Bayesian network decision reasoning software for artificial intelligence processing of information, and Sarnoff Laboratories image processing.

The AI center 300 is preferably powered up from the battery pack in the solar power system 302 when incoming signals are being received, analyzed, or transmitted. Otherwise, the AI center 300 is preferably powered down in a hibernation mode. When powered up, the AI center 300 may generate appreciable heat, and it is preferred to include a thermal management unit 311 comprising several fins for radiating heat away from the AI center 300.

A receiver 306 in the AI center 300 is located atop the jungle canopy and has the function of receiving wireless signals from the ground-based network of sensor-relays as shown in FIG. 1. A transmitter 307 in the AI center 300 is preferably located atop the jungle canopy and has the function of using triangulation of wireless signals from several AI centers in order to determine the coordinates of each sensor-relay unit in the sensor-relay network 103 on the jungle floor. If the jungle floor is not flat, as in a river valley, appropriate corrections can be made by the AI center 300.

Preferably, hanging below the bulk of the AI center 300 is a lower antenna 308. This may be a whip antenna and preferably comprises of a long, very flexible, and camouflaged wire, perhaps 10-60 meters in length, more preferably 20 meters in length. This antenna may be used for triangulation, as noted above, or for other communication roles within the forest canopy.

Preferably attached to the base of the whip antenna 308 is a supplemental sensor package 309. The sensor package 309 comprises an optional downward facing camera plus other optional sensor features known in the art as described above. The sensor package 309 is directly connected to the AI center 300 by a separate very thin wire running parallel to the whip antenna 308. The sensors chosen for the AI center 300 are supplemental, and may be the same or different from those chosen for the sensor-relay units 200. The weight of the AI center 300 is approximately 10-100 kg, more preferably, 25-75 kg, even more preferably 50 kg.

The buoy support system for positioning an intelligence gathering center atop a jungle canopy is a novel concept; nothing like it exists in the literature. A plan view of the buoy support structure 304 is shown schematically in FIG. 4. The most striking parts of this drawing are the eight radially-disposed spider leg supports 402. Of course, 4, 5, 6, 7, 9, 10, or more legs could be used, disposed radially, axially, spherically, or any combination thereof. The preferred spider leg supports 402 are disposed radially outwards from the buoy core, similar to the extension of an umbrella. The extension can be perpendicular to the longitudinal axis of the buoy support structure 304, or it may be angled at some plus or minus angle with respect to the longitudinal axis. The radial length of each of the leg supports 402 can be approximately 2 to 20 meters (9 to 30 feet), and more preferably 3-10 meters, allowing the buoy support structure 304 to have an impressively large diameter in the range of 6 to 20 meters (18 to 60 ft) that is adequate for attachment of the AI center 300 to the forest canopy. The leg supports 402 may be the same length, or they may have different lengths; for example, alternating long (10 meters) and short (3 meters) lengths. The large diameter of the spider leg support structure 304 is not drawn to scale in FIG. 4 for purposes of clarity. Prior to deployment, the spider legs supports 402 are preferably compressed into a small volume, by, for example, telescoping rods, folding rods, or a combination thereof. After deployment, the spider leg supports 402 are extended by means such as uncoiling (as in a spring), unfurling (as in flag), unfolding (as in an umbrella), etc. The spider leg materials are preferentially made of metal and/or plastic. The cross section of the spider leg supports 402 is preferably tube-shaped or U-shaped, in order to have maximum strength per unit weight. When properly positioned by aircraft or helicopter, the spider leg supports 402 of the buoy support structure 304 allow the AI center 300 to "float" atop the jungle canopy. It will be shown below that there are additional means for mechanically fastening the AI center to the forest canopy.

Near the center of the buoy support structure 400 are preferably positioned inner and outer circular supports 403, which are preferably bonded to the spider leg supports 402 and strengthen them. These circular supports 403 are preferably made of metal, plastic, carbon fiber, and/or Kevlar. with cross sections similar to that of the spider leg supports 402. Circular supports 403 are preferably located in a substantially horizontal plane so that they can effectively serve as shock-absorbers, and as antennas for transmitting surveillance information upward to the overhead satellite 310. Also near the center of the buoy support structure 400 are preferably several solar panels 404. These are composed of photovoltaic cells and other circuitry. The solar panels are black so they would be less visible from the air or ground.

In case of deploying the AI center 300 by dropping from an airplane on to the jungle canopy, it may be desirable to take precautions to slow the velocity of impact, by adding one or more air-inflatable camouflaged parachutes and/or airbags in the form of air bags 315 discussed below, attached to the buoy support structure. The parachute(s) and/or air bags should be made of biodegradable material, so that they will decompose in a jungle environment. Also, it may be desirable to use flexible or foldable solar panels, which would increase their impact resistance. Also, it may be desirable to include additional mechanical means for axis and azimuth rotation of an inadvertently tilted AI center 300 after deployment, so as to optimize its satellite transmission performance. For example, one or more of the legs may be actuated by one or more electric motors or hydraulic or compressed-air systems to move vertically and/or horizontally to position the AI center substantially upright (e.g., within 20 degrees of vertical), as detected by one or more gyroscopes or bubble-level mechanisms disposed in the AI center. However, in case of a gentle deployment of the AI center 300 directly on the jungle canopy by using a hovering helicopter, these precautions may not be necessary.

Figure 4:
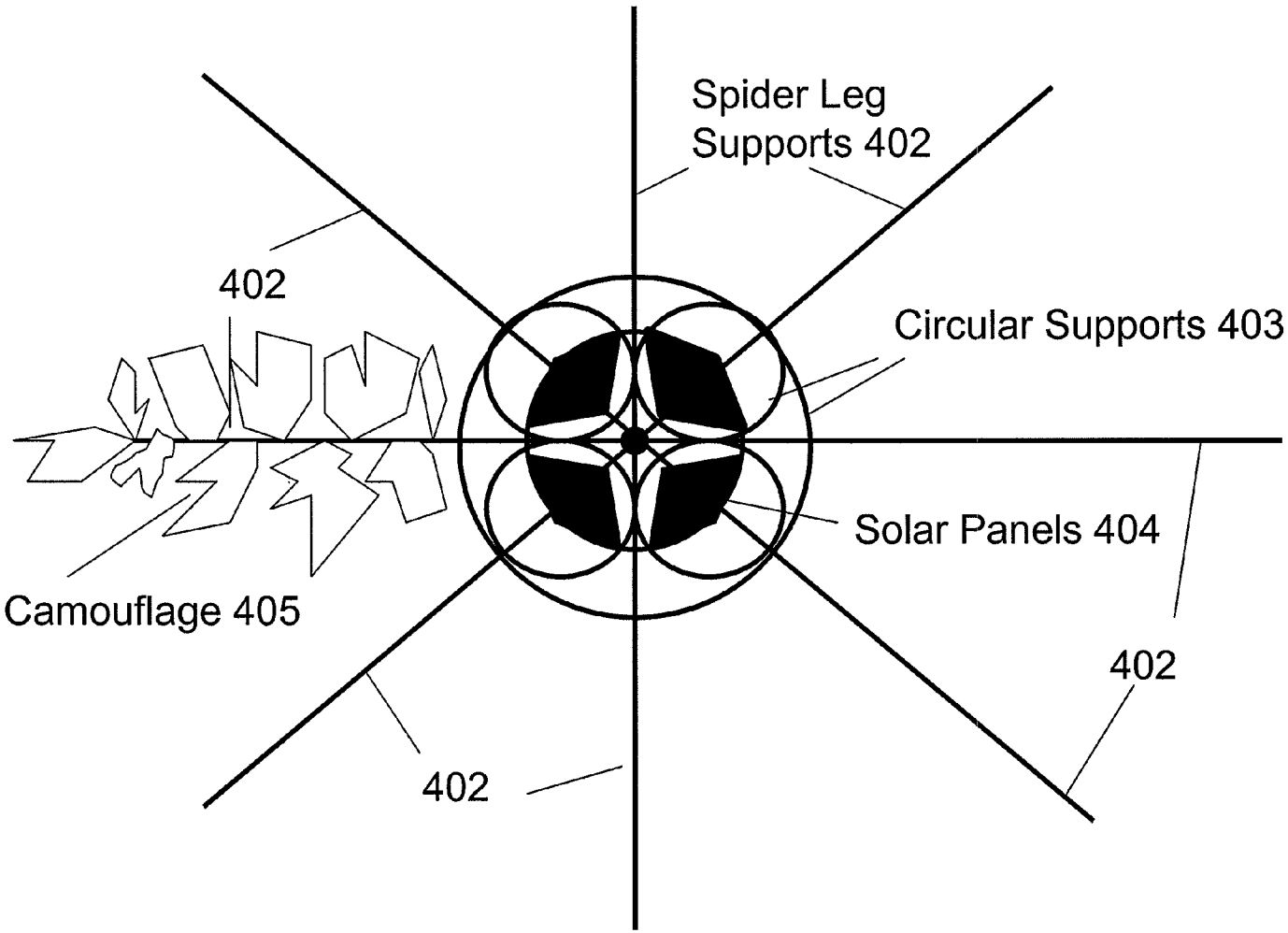
FIG. 4 is a schematic plan view of a buoy support structure according to an embodiment of the present invention.

Camouflage is desirable to the surveillance effort. An example of this is shown in FIG. 4 as camouflage 405, which preferably comprises thin appendages resembling leafy structures which cover the spider leg supports 402. For clarity, only one of the camouflaged spider leg supports is shown in FIG. 4, although many (if not all) of the legs will be so-camouflaged. The appendages can be made of metal, plastic, or cloth, and are colored for best camouflage in the environment of the particular target jungle canopy. Camouflage 405 can also be used to assist adhesion. In a preferred embodiment, the camouflage 405 exposes a sticky glue surface upon deployment. When the glue contacts the jungle canopy it rigidly fastens the AI center to the jungle canopy. Optionally, one or more grappling hooks can be used, alone or in combination with the other attachment systems described above, to secure the AI center 300 to the jungle canopy. Additional camouflage, similar to camouflage 405, can be attached to the body of the AI center 300, including its upper antenna 304, its circular supports 403 (preferably also serving as an antenna) and its lower antenna 308.

Figure 5:
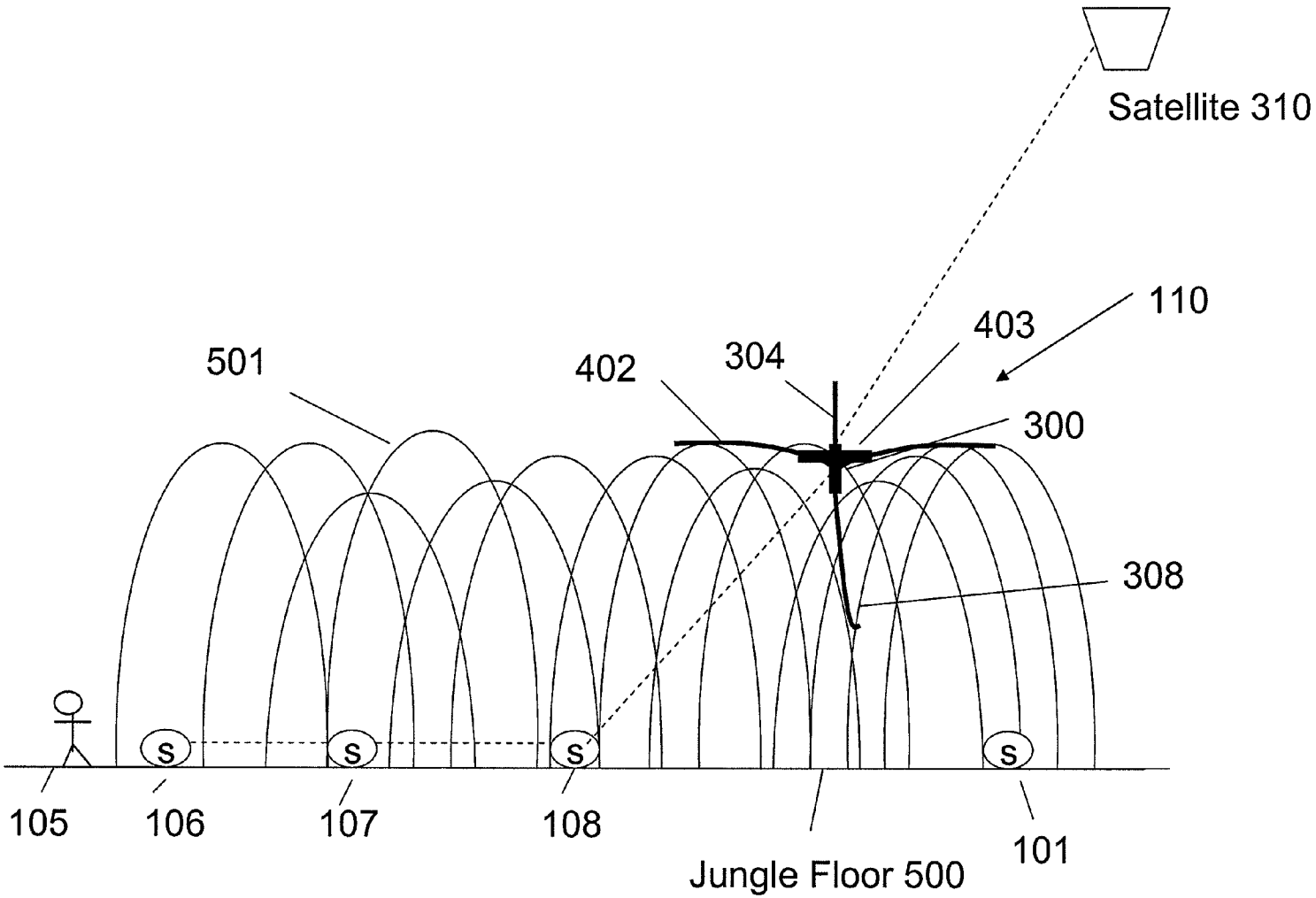
FIG. 5 is a schematic elevation view of a surveillance system network according to an embodiment of the present invention.

A schematic elevation view of the surveillance system network 100 is shown in FIG. 5, which corresponds to the plan view of the surveillance system network as shown in FIG. 1. In FIG. 5, the jungle floor 500 and the jungle canopy 501 are shown. Jungle canopy 501 is depicted in FIG. 5 as a multiplicity of overlapping tree tops. Positioned on the jungle floor is a human presence 105. Positioned atop the jungle canopy 501 is the AI center 110. Shown in intentionally-exaggerated form are the spider leg supports 402, upper antenna 304, lower antenna 308, and outer circular support 403. Positioned on the jungle floor 500 are several sensor-relay units 101, 106, 107, and 108. Sensor-relay unit 101 is a generic unit and may not participate in a particular surveillance operation if it is located too far away from the human presence 105. It is seen from FIG. 5 that sensor-relay unit 106 is closest to the human presence 105 and receives one or more signals therefrom (call this signal X). Then, signal X is relayed (preferably with amplification) to nearby sensor-relay unit 107, where it is again relayed to nearby sensor-relay unit 108, where it is again is relayed to the AI center 110, where it is detected by the receiver 306 of the nearby AI center 110 located atop the jungle canopy. Thus, by this means of sequential hops, signal X makes its way across the jungle floor and winds up being detected at the AI center 110 located atop the jungle canopy.

Inside AI center 110, the signal X is analyzed in the artificial intelligence package 305 embedded in the AI center 300. This signal is preferably compared with other signals from the same sensor location and compared with other signals from other sensors as a function of time and space, to determine if there is a human presence such as a person, tank, jeep, etc. Each AI center 300 also preferably receives signals from its supplemental sensor package 309 and these are also folded into the surveillance analysis.

The AI center 300 compiles the signal data thus received from all sensor sources to determine the presence, movement, and/or change of human presence over time. The AI center 300 compiles a natural language report which is user-friendly and describes the movement and change of human presence over time. This report is supplemented, if possible, by relevant photos taken by the sensor relay units 200 or the AI centers 300. Then, this user-friendly report is sent via satellite transmitter 303 to the overhead satellite 310. It is also possible, in some cases, to transmit the report under the jungle canopy using the lower antenna 308 to other AI centers 300 which may have better satellite or aircraft connections, or a ground station connection. If some of the sensor-relay units 200 or AI centers 300 are detected and destroyed by a human presence 105, this will not affect the utility of the network since there is preferably a multiplicity and redundancy of sensor-relay units 200 and AI centers 300 in the surveillance system network 100.

For most of the time, sensor-relay units 200 and AI centers 300 remain in a low-power hibernation state in order to preserve battery energy and to reduce their detection since stealth is important. Only when new signals occur or when the AI center is analyzing the incoming signals will the sensor-relay units 200 and AI centers 300 utilize most of the battery energy. As noted above, each AI center 300 preferably has renewable energy from the solar power system 302, while the sensor-relay units 200 may not have renewable energy and would be replaced when their battery energy is depleted.

Thus, the AI center has been shown to take a proactive role in the collection, compilation, and transmission of surveillance data to a satellite. In another embodiment, an even more proactive method of operation is provided where the AI center 200 analyzes the data, produces a report, sends the report to a satellite, and then takes extra action not described above. This extra action may be precipitated by the AI center receiving from the satellite at a subsequent time a special engagement order from responsible personnel. In this more proactive embodiment, when the AI center receives the special engagement order, the AI center transmits additional signals to the ground covered by the surveillance system network 100 which trigger an engagement of a non-lethal or lethal nature, using equipment previously placed in the vicinity.

In the preferred embodiments discussed above, sensor-relay units 200 are used for simplicity of system operation and for reduction in cost and parts count. However, for some special cases it may be desirable to have separate supplemental sensor networks and/or separate supplemental relay networks using different mixes of sensors, processors, transmitters, receivers, antennas, etc. It is also possible to utilize an additional sensor sub-network appended to the surveillance system network 100.

With respect to software, most of the AI package 305 in the AI center 300 incorporates software that is presently available commercially and known in the art. According to a preferred embodiment, one or more computer programs, modules, or kernels are provided to subtract (or filter) out electromagnetic and/or acoustic noise, such as jungle noises, from appropriate sensors (e.g., acoustic sensors) positioned on the jungle floor.

The individual components shown in outline or designated by blocks in the attached Drawings are all well-known in the electrical and mechanical arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A system for surveillance of human presence in a jungle canopy environment, comprising:

a plurality of sensor-relay units configured to be disposed on or near a jungle floor, and configured to detect human presence and wirelessly transmit a corresponding detection signal, with one or more of said sensor-relay units being configured to receive a detection signal from another sensor-relay unit on or near said jungle floor and relay the thus-received detection signal; and an artificial intelligence center configured to be disposed on or near a top of the jungle canopy, and configured to:

(i) receive at least one of the detection signal and a relayed said detection signal, (ii) analyze a received at least one of the detection signal and the relayed detection signal using artificial intelligence software, and (iii) transmit a corresponding report signal to a receiving platform remotely located from said plurality of sensor-relay units.

2. The system according to claim 1, wherein the report signal comprises a natural-language report signal.

3. The system according to claim 1, wherein the report signal comprises at least one image signal.

4. The system according to claim 1, wherein said artificial intelligence center is configured to transmit the corresponding report signal to a satellite.

5. The system according to claim 1, further comprising a plurality of artificial intelligence centers.

6. The system according to claim 5, wherein the number of sensor-relay units exceeds the number of artificial intelligence centers by a factor in the range 10-100.

7. The system according to claim 1, wherein said artificial intelligence center includes at least one expandable camouflaged airbag which, upon airborne deployment is configured to:

(i) slow the descent of the corresponding artificial intelligence center, and, (ii) maintain the corresponding artificial intelligence center in a substantially vertical position.

8. The system according to claim 1, wherein said artificial intelligence center includes a down-facing camera which is configured to view the jungle floor in the vicinity of said artificial intelligence center.

9. The system according to claim 1, wherein said artificial intelligence center is supported by a buoy structure at the top or near the top of the jungle canopy, allowing said artificial intelligence center to float on the top or near the top of said jungle canopy.

10. The system according to claim 9, wherein at least one of said plurality of substantially radially-disposed leg elements and at least a portion of a surface of the corresponding artificial intelligence center are camouflaged with appendages resembling leafy structures.

11. The system according to claim 9, wherein said buoy structure comprises a plurality of substantially radially disposed leg elements.

12. The system according to claim 11, wherein said plurality of substantially radially-disposed leg elements are substantially 3-10 meters in length.

13. The system according to claim 11, wherein at least one of said plurality of substantially radially-disposed leg elements includes adhering structure that mechanically adheres the corresponding artificial intelligence center to the jungle canopy.

14. A method of operating a jungle surveillance system having:

(i) a plurality of sensor-relay units disposed on or near the jungle floor, and (ii) at least one artificial intelligence center disposed on or near the top of the jungle canopy, comprising:

wirelessly transmitting surveillance signals from at least one of said plurality of the sensor-relay units to said at least one artificial intelligence center;

wirelessly transmitting surveillance signals from at least one of said plurality of the sensor-relay units to another one of said plurality of the sensor-relay units, which relays the thus-received surveillance signals to said at least one artificial intelligence center;

receiving at said at least one artificial intelligence center, (i) the transmitted surveillance signals, and (ii) the relayed surveillance signals;

analyzing at said at least one artificial intelligence center the received transmitted surveillance signals and the relayed surveillance signals, using artificial intelligence software;

producing at least one artificial intelligence center a natural language surveillance report corresponding to the analyzed received transmitted surveillance signals and the relayed surveillance signals; and transmitting the surveillance report from said at least one artificial intelligence center to a remote platform.

15. The method according to claim 14, wherein when said at least one artificial intelligence center receives surveillance signals from a sensor-relay unit, transmitting from said at least one artificial intelligence center a control message to said plurality of sensor-relay units to stop transmitting subsequent duplicate signals.

16. The method according to claim 14, further comprising deploying said plurality of sensor-relay units from an aerial platform to the jungle floor, and wherein at least one inflatable air bag is used to the slow descent of each sensor-relay unit and reduce impact.

17. The method according to claim 16, further comprising camouflaging said at least one air bag.

18. The method according to claim 16 further comprising constructing said at least one air bag of a biodegradable material.

19. The method according to claim 14, further comprising deploying said at least one artificial intelligence center from an aerial platform to the top or near a top of the jungle canopy, and further comprising using inflatable air bags to slow descent and reduce impact of said at least one artificial intelligence center.

20. The method according to claim 19 further comprising camouflaging said airbags.

21. The method according to claim 19 further comprising constructing said air bags of a biodegradable material.

22. The method according to claim 14, further comprising deploying said at least one artificial intelligence center on the top or near the top of said jungle canopy from a helicopter.

23. The method according to claim 14, further comprising following said transmitting step, said at least one artificial intelligence center receiving an engagement order, and in response thereto, causing at least one of said plurality of sensor-relay units to engage the detected human presence with non-lethal or lethal equipment.

24. The method according to claim 14, further comprising floating said artificial intelligence center on a top of or near a top of said jungle canopy.

25. The method according to claim 14, further comprising using from about 10-100 said plurality of sensor-relay units for each said artificial intelligence center.

26. The method according to claim 14 wherein said transmitting the surveillance report from said at least one artificial intelligence center to a remote platform further comprises transmitting the surveillance report to an aerial or space-based platform.

* * * * *